US006808025B2

(12) United States Patent
Bissen et al.

(10) Patent No.: US 6,808,025 B2
(45) Date of Patent: Oct. 26, 2004

(54) FIRE-FIGHTING SYSTEM HAVING IMPROVED FLOW

(75) Inventors: David R. Bissen, Plymouth, MN (US); William F. Burch, Long Beach, CA (US); Lawrence P. Schmidt, Lino Lakes, MN (US)

(73) Assignee: Schwing America, Inc., White Bear Lake, MN (US)

( * ) Notice: Subject to any disclaimer, the term of this patent is extended or adjusted under 35 U.S.C. 154(b) by 556 days.

(21) Appl. No.: 09/931,666

(22) Filed: Aug. 16, 2001

(65) Prior Publication Data

US 2003/0066659 A1 Apr. 10, 2003

Related U.S. Application Data

(63) Continuation of application No. 09/393,464, filed on Sep. 10, 1999, now abandoned.

(51) Int. Cl.[7] ..... A62C 2/00

(52) U.S. Cl. ..... 169/47; 169/24; 239/166; 239/172

(58) Field of Search ..... 169/24, 47; 239/166, 239/172

(56) References Cited

U.S. PATENT DOCUMENTS

| | | | | |
|---|---|---|---|---|
| 3,253,677 | A | 5/1966 | Krynytzky et al. | 169/24 |
| 3,685,543 | A | 8/1972 | Schwing et al. | 137/615 |
| 5,045,217 | A | 9/1991 | Ronan et al. | 210/776 |
| 5,211,245 | A | 5/1993 | Relyea et al. | 169/24 |
| 5,488,995 | A | 2/1996 | Kuwahara | 169/24 |
| 5,566,766 | A | 10/1996 | Williams | 169/43 |
| 5,746,396 | A | 5/1998 | Thorton-Trump | 169/24 |

*Primary Examiner*—Christopher Kim
(74) *Attorney, Agent, or Firm*—Kinney & Lange, P.A.

(57) ABSTRACT

An improved fire-fighting device designed to allow variable positioning of a quenching agent dispensing point. The fire-fighting device also allows high quenching agent flow rates. The device uses an articulable boom arrangement and solid pipeline to achieve these advantages.

23 Claims, 5 Drawing Sheets

100
102
104
46
106
108
110
112
114
116
118
120
122

94a
92
32
96
94b
94c
28

FIRE-FIGHTING SYSTEM HAVING IMPROVED FLOW

CROSS-REFERENCE TO RELATED APPLICATION(S)

This application is a continuation of U.S. patent application Ser. No. 09/393,464, filed Sep. 10, 1999 for "Fire-Fighting System Having Improved Flow" by David R. Bissen, William F. Burch, and Lawrence P. Schmidt.

BACKGROUND OF THE INVENTION

The present invention relates to an improved device for use in fighting fires. More particularly, it relates to an improved device for conveying a quenching agent from the fire-fighting vehicle to an advantageous application point.

To effectively contain and extinguish fires, it is necessary to accurately direct the flow of a quenching agent such that it makes contact with the source of the fire. This task is often made difficult by the inaccessibility of the fire's source caused by intervening obstacles or the heat radiating from the fire itself. Also, the fire is often not located near a quenching agent supply, and the quenching agent must be conveyed a substantial distance from its supply to the source of the fire. Prior art systems often employed either a telescoping boom or a water cannon to deliver quenching agent from a distant location. An exemplary device, employing a telescoping boom, is disclosed in U.S. patent application Ser. No. 4,875,526, issued Oct. 24, 1989 to Latino, et al. entitled "ROUGH TERRAIN, LARGE WATER VOLUME, TRACK DRIVEN FIRE-FIGHTING APPARATUS AND METHOD." The prior art devices suffer from a lack of accuracy and dispensing range. The prior art devices also are incapable of conveying large flow rates of quenching agent.

There is a need in the art for a fire-fighting vehicle having the ability to pinpoint the position of the quenching agent dispensing point from a remote location. Also, there is a need in the art for a fire-fighting vehicle capable of conveying large volumetric flow rates of quenching agent.

BRIEF SUMMARY OF THE INVENTION

The present invention is an improved fire-fighting vehicle having an articulable boom for accurate positioning of a nozzle near a fire source. The improved fire-fighting vehicle includes a vehicle chassis for rotatably supporting a plurality of boom sections. It further includes a conveying pipeline having an inside diameter of approximately six inches or greater and allowing a quenching agent throughput of at least 3,000 gallons per minute. The improved fire-fighting vehicle also includes a nozzle connected to a distal end of the conveying pipeline at a distal end of the outermost boom section.

DETAILED DESCRIPTION

Figure 1:
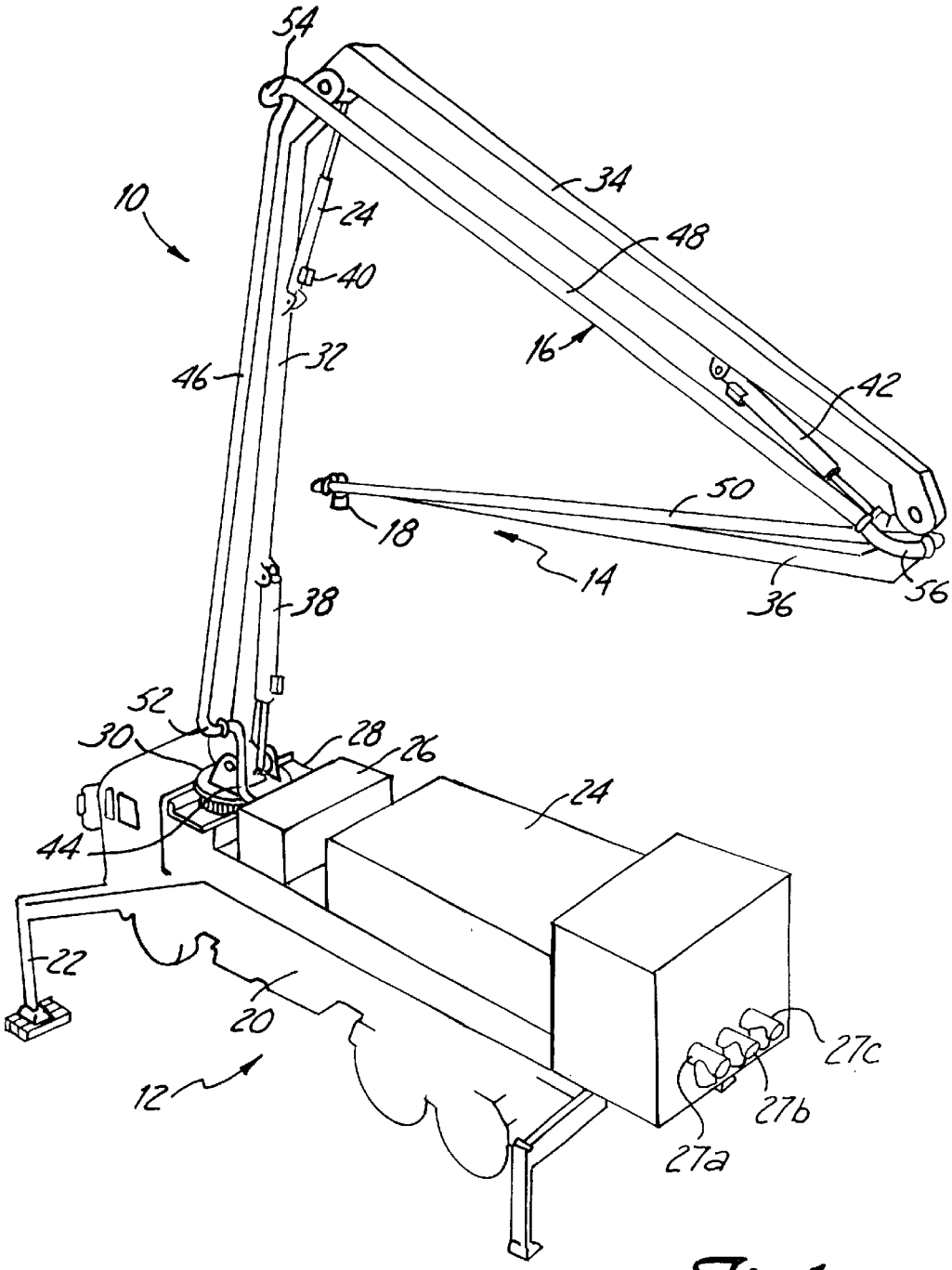
FIG. 1 is a perspective view of a fire-fighting vehicle in accordance with the present invention.

FIG. 1 shows a perspective view of a fire-fighting system 10 according to the present invention. The fire-fighting system 10 includes a truck 12, a boom 14, a conveying pipeline 16, and a nozzle 18. The truck 12 acts as a support or a base for the boom 14. The boom 14 supports and articulates the conveying pipeline 16. The truck 12 provides the ability for the fire-fighting system 10 to be mobile and transported to a location near the vicinity of the fire. The boom 14 and the conveying pipeline 16 function to allow the dispensing point of a quenching agent (not shown) to be located near the fire source. The quenching agent is dispensed through the nozzle 18, which is mounted at the outermost end of the boom 14. Although the preferred embodiment, as shown in FIG. 1, shows the fire-fighting system 10 having a boom 14 and conveying pipeline 16 mounted on the truck 12, in other embodiments the boom 14 and conveying pipeline 16 may be mounted on a stationary support. Also, in some embodiments a monitor (not shown) may be placed between the outermost end of the boom 14 and the nozzle 18 to adjust the spray direction of the nozzle 18.

The truck 12 includes a chassis 20, outriggers 22, a tank 24, a pump 26, three hose connectors 27*a*, 27*b*, 27*c*, and a boom base 28. The chassis 20 of the truck 12 provides the main structural support for supporting the boom 14 and the conveying pipeline 16. The outriggers 22 extend laterally from the chassis 20 and impose a downward force on the surrounding ground. The outriggers 22 function to stabilize the truck 12 and prevent it from tipping during deployment of the boom 14 and conveying pipeline 16. The tank 24 holds a supply of the quenching agent used to suppress or quench the fire. The quenching agent is commonly water or a fire retardant chemical foam.

The quenching agent may also be supplied by a source external to the truck 12. In this case, the quenching agent is supplied to the pump 26 from an external source (not shown) by connecting hoses between the external source and the hose connectors 27*a*, 27*b*, 27*c*. The hose connectors 27*a*, 27*b*, 27*c* then couple to an eight inch manifold pipeline (not shown), which connects to the pump 26. The pump 26 acts to move quenching agent through the conveying pipeline 16 and out the nozzle 18. The base 28 provides a surface for mounting the boom 14. The boom 14 includes a turret 30, a first boom section 32 a second boom section 34, a third boom section 36, a first actuator assembly 38, a second actuator assembly 40, and a third actuator assembly 42.

In a preferred embodiment, the truck 12 includes a tank 24 for storing about 850 gallons of fire retardant chemical foam, and the water is provided by an external source. The tank is constructed from fiberglass using resins selected to be compatible with the fire retardant chemical foam. In a preferred embodiment, the truck does not include a tank for storing water. In a preferred embodiment the quenching agent is a mixture of approximately two to six percent by volume of fire retardant chemical foam in water. The foam is injected into the water supply using methods generally known to those of skill in the fire fighting devices art.

The turret 30 of the boom 14 is mounted to the base 28 of the truck 12. The turret 30 allows rotatable motion, about a vertical axis, of the boom 14 with respect to the truck 12. As shown in FIG. 1, a proximal end of the first boom section 32 is pivotally coupled to the turret 30. A distal end of the first boom section 32 is pivotally connected to a proximal end of the second boom section 34. A distal end of the second boom section 34 is pivotally connected to a proximal end of the third boom section 36. Although the preferred embodiment shown in FIG. 1 includes three boom sections, the boom 14 could include any number of boom sections.

As shown in FIG. 1, the first actuator assembly 38 is connected between the turret 30 and the first boom section 32. The first actuator assembly 38 extends or retracts to control the angular position of the first boom section 32 with respect to the truck 12. The second actuator assembly 40 is coupled between the first boom section 32 and the second boom section 34 and controls the angular position of the second boom section 34 with respect to the first boom section 32. The third actuator assembly 42 is coupled between the second boom section 34 and the third boom section 36 and controls the angular position of the third boom section 36 with respect to the second boom section 34. An operator of the fire-fighting system 10 can control the position of the distal end of the third boom section 36 by controlling the positions of the turret 30, the first actuator assembly 38, the second actuator assembly 40, and the third actuator assembly 42. The position of the distal end of the third boom section 36, where the nozzle 18 is located, determines the dispensing point of the quenching agent.

The conveying pipeline 16, as shown moving from left to right in FIG. 1, includes a feed pipe section 44, a first pipe section 46, a second pipe section 48, a third pipe section 50, a first pipeline joint 52, a second pipeline joint 54, and a third pipeline joint 56. The first pipe section 46 is pivotally coupled to the feed pipe section 44 by the first pipeline joint 52. The second pipe section 48 if pivotally coupled to the first pipe section 46 by the second pipeline joint 54. The third pipe section 50 is pivotally coupled to the second pipe section 48 by the third pipeline joint 56. A distal end of the third pipe section 50 is coupled to the nozzle 18. The various pipe sections 46, 48, 50 are rigidly coupled to the respective boom sections 32, 34, 36. During motion of the boom 14 by an operator, the pipeline joints 52, 54, 56 allow the pipe sections 46, 48, 50 to pivot along with the boom sections 32, 34, 36. The pipeline joints 52, 54, 56 allow pivotal motion while maintaining a liquid seal such that the quenching agent does not leak out of the conveying pipeline 16.

The fire-fighting system 10 of the present invention allows an operator to manipulate the actuators and strategically position the nozzle 18 for maximum fire-fighting efficacy. The fire-fighting system 10 of the present invention also teaches a solid-walled pipeline having a large diameter that allows large quenching agent flow rates. The boom sections 32, 34, 36 are generally constructed from a high-strength steel giving them the necessary strength and durability to operate in the vicinity of a fire and the pipe sections 46, 48, 50 are generally constructed from aluminum to minimize the weight that the boom sections 32, 34, 36 must support.

Figure 2:
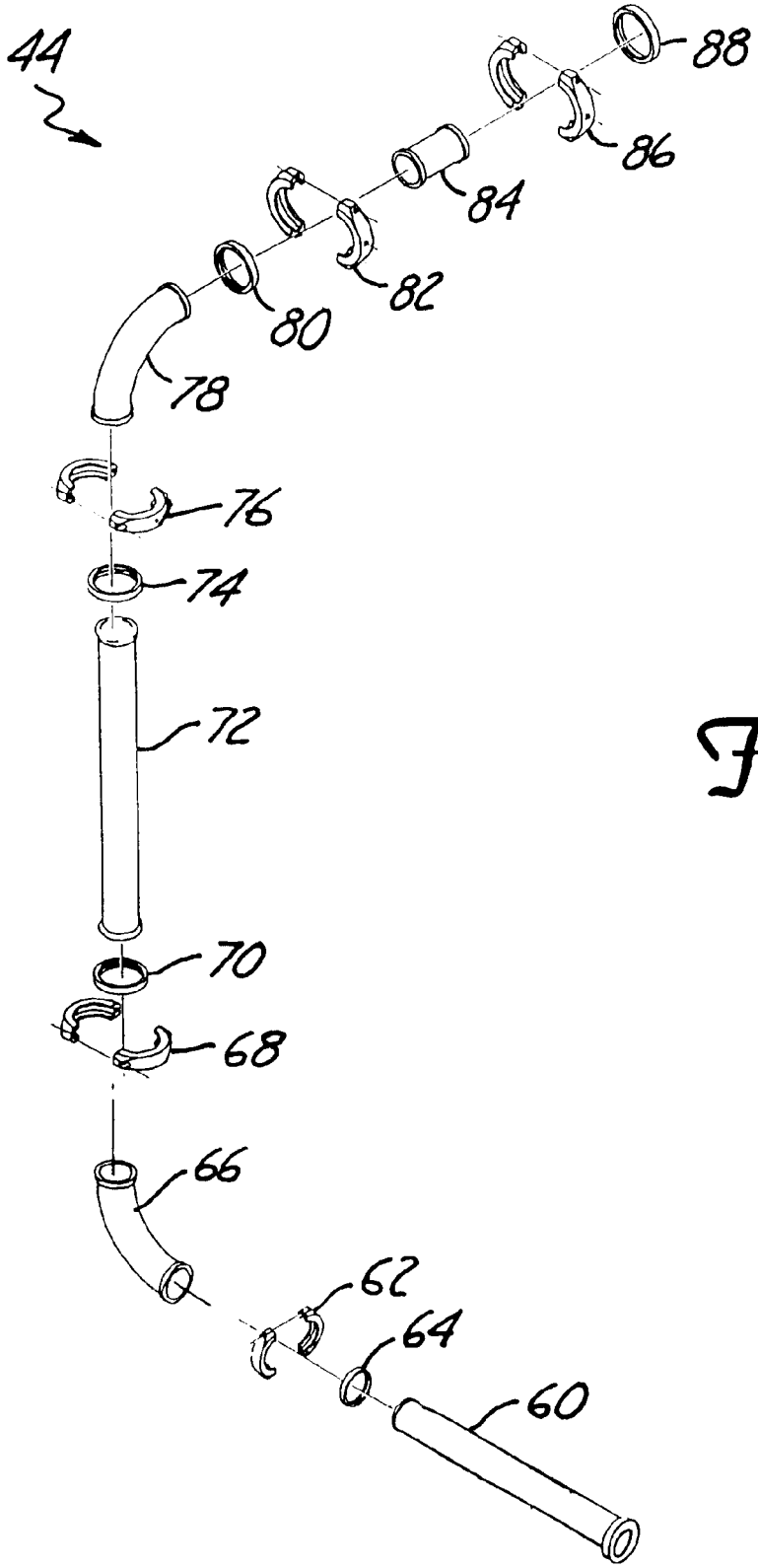
FIG. 2 is an exploded perspective view of an inlet pipeline according to the present invention.

FIG. 2 is an exploded perspective view of the feed pipe section 44. The feed pipe section 44 carries the quenching agent from the tank 24 to a proximal end of the first pipe section 46. As shown in FIG. 2, moving from a proximal end (the end near the tank 24 holding the quenching agent) to a distal end, the feed pipe section 44 includes a pipe 60, a rigid coupling 62, a sealing ring 64, a pipe elbow 66, a fixed coupling 68, a sealing ring 70, a horizontal pipe 72, a sealing ring 74, a swivel coupling 76, a pipe elbow 78, a sealing ring 80, a swivel coupling 82, a pipe 84, a swivel coupling 86, and a sealing ring 88. The feed pipe 44 is configured such that it allows rotation of the turret 30 about a vertical axis and pivotal motion of the first pipe section 46 without compromising the integrity of the feed pipe section 44. In other words, the feed pipe section 44 must maintain a seal such that it will completely contain the quenching agent. The components of the feed pipe section 44 which allow these movements are the swivel couplings 86, 82, and 76. The swivel couplings 82 and 86 are mounted to the pipe 84 which is disposed in a horizontal plane generally parallel to the ground on which the truck 12 is supported. The swivel couplings 82 and 86 allow pivotal motion of the first pipe section 46 with respect to the feed pipe section 44. The pipe elbow 78 turns the feed pipe section 44 ninety degrees such that the feed pipe section 44 runs toward the bottom of the truck 12. The vertical pipe 72 runs through the center of the turret 30 and is disposed concentric thereto. The swivel coupling 76 allows the feed pipe section 44 to maintain integrity during rotation of the turret 30. The remaining components of the feed pipe section 44 are fixed and connect to the tank 24 or other quenching agent source.

Figures 3A, 3B:
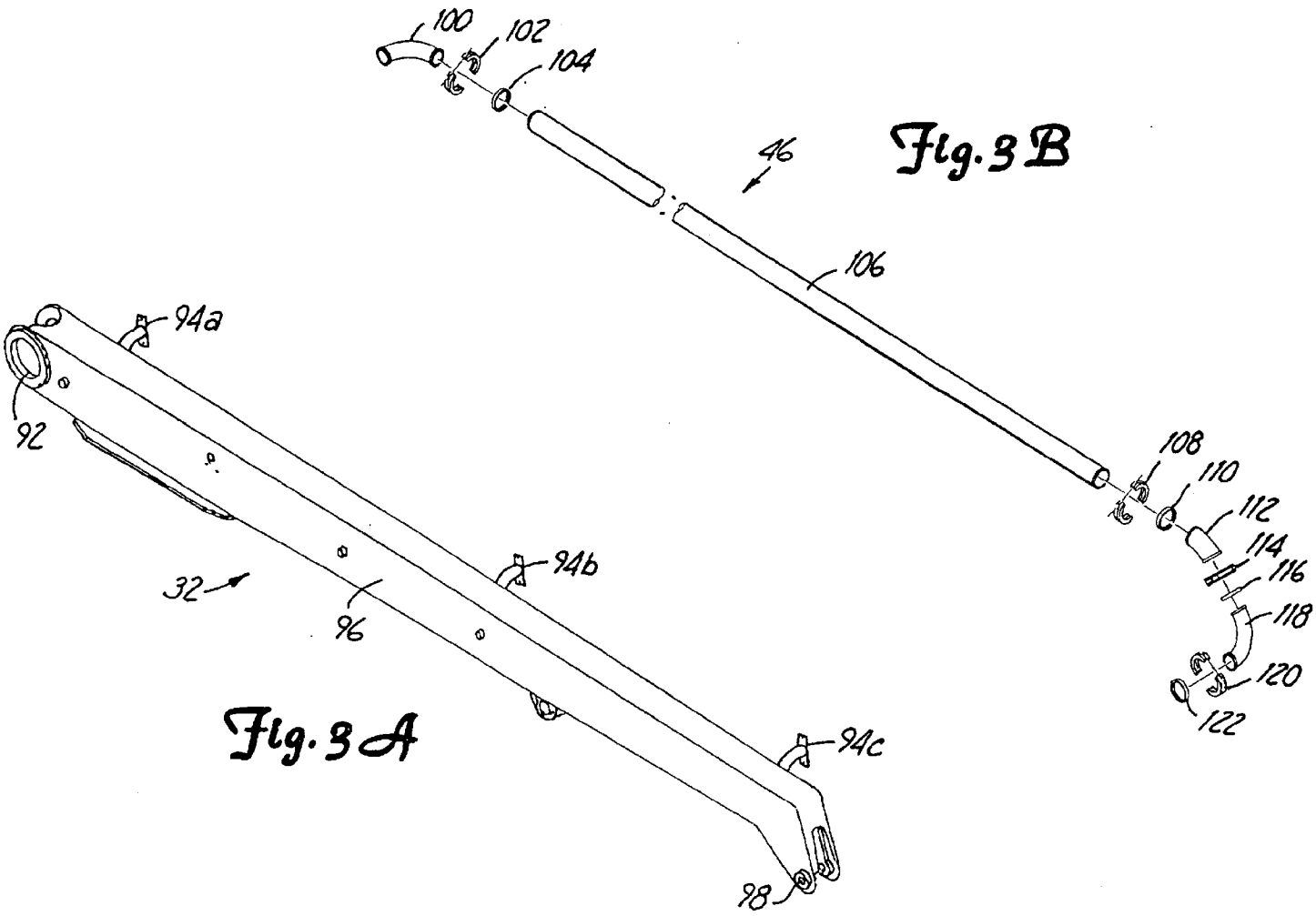
FIG. 3A is a perspective view of a first boom section according to the present invention.
FIG. 3B is an exploded perspective view of a first pipeline section according to the present invention.

FIGS. 3A and 3B show perspective views of the first boom section 32 and the first pipe section 46, respectively. The first pipe section 46, which is supported by the first boom section 32, carries quenching agent from the distal end of the feed pipe section 44 to the proximal end of the second pipe section 48. The first boom section 32, shown in FIG. 3A, and the first pipe section 46, shown in FIG. 3B, are illustrated with the proximal end on the left side of the figures. In other words, the quenching agent would move through the first pipe section 46 from the left side to the right side of FIG. 3B.

As shown in FIG. 3A, moving from left to right, the first boom section 32 includes a proximal coupling 92, three pipe supports 94*a*, 94*b*, 94*c*, a boom body 96, and a distal coupling 98. The proximal coupling 92 of the first boom section 32 couples to the turret 30 on the truck 12. The boom body 96 provides the main structural support for the first boom section 32. The pipe supports 94*a*, 94*b*, 94*c* are welded to the boom body 96 and support the first pipe section 46. The distal coupling 98, shown at the far left in FIG. 3A, connects to a proximal end of the second boom section 34. Both the proximal coupling 92 and the distal coupling 98 allow pivotal rotation of the first boom section 32 with respect to the adjacent boom sections.

As shown in FIG. 3B, moving from left to right, the first pipe section 46 includes a pipe elbow 100, a rigid coupling 102, a sealing ring 104, a pipe 106, a rigid coupling 108, a sealing ring 110, a pipe elbow 112, a rigid coupling 114, a sealing ring 116, a pipe elbow 118, a swivel coupling 120, and a sealing ring 122. The first pipe section 46 is configured such that it allows for pivotal motion of the second pipe section 48 without compromising the integrity of the conveying pipeline 16. In other words, the first pipe section 46 and the second pipe section 48 must maintain a seal such that they completely contain the quenching agent. The component of the first pipe section 46 that allows pivotal motion of the second pipe section 48 is the swivel coupling 120. The pipe elbow 100, shown on the left side of FIG. 3B, pivotally couples to the pipe 84 of the feed pipe section 44 using the swivel coupling 86. The remainder of the recited components of the first pipe section 46 are then coupled together in an end-to-end manner and attached to the pipe supports 94*a*, 94*b*, 94*c* of the first boom section 32.

Figures 4A, 4B:
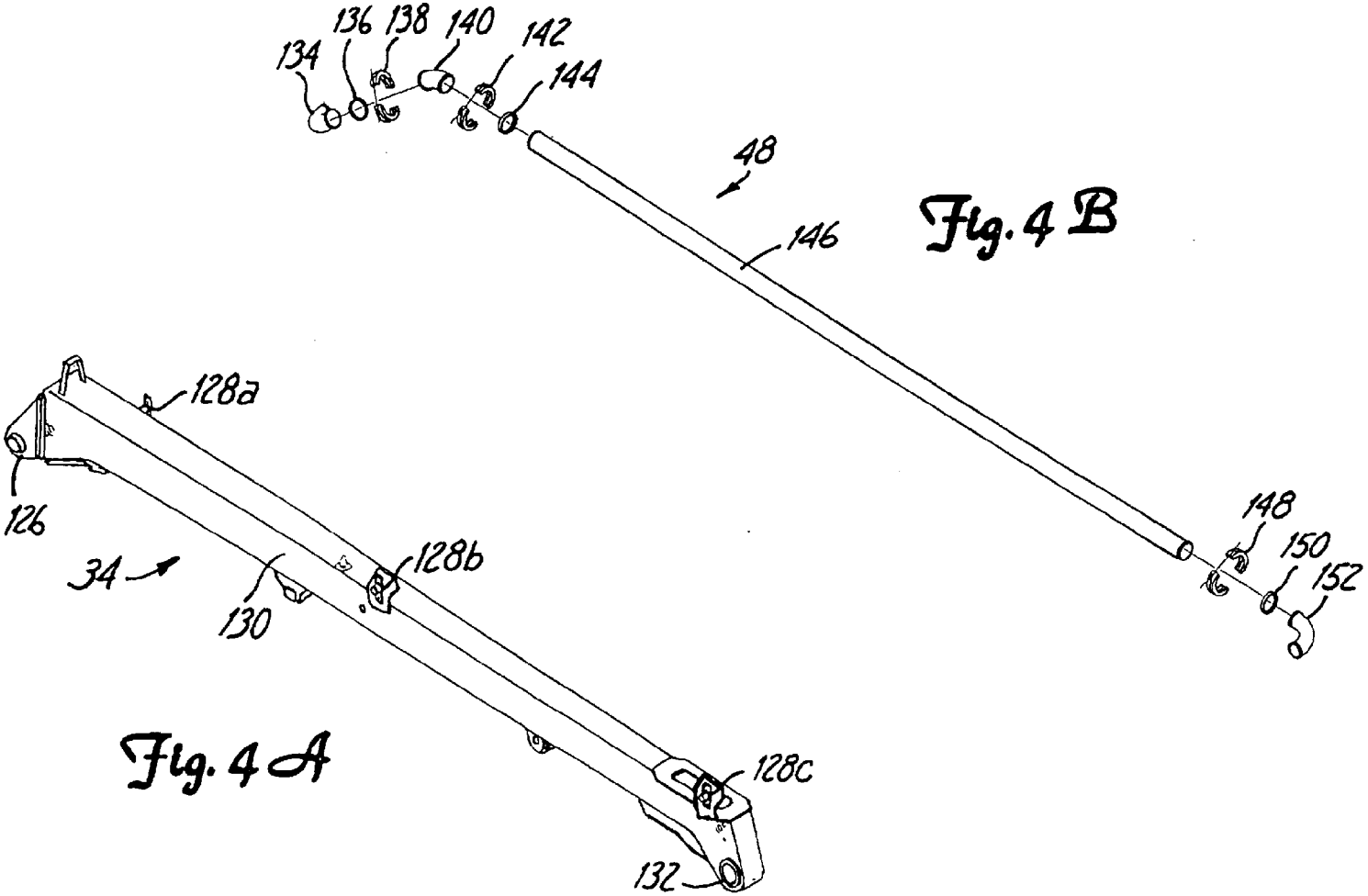
FIG. 4A is a perspective view of a second boom section according to the present invention.
FIG. 4B is an exploded perspective view of a second pipeline section according to the present invention.

FIGS. 4A and 4B show perspective views of the second boom section 34 and the second pipe section 48, respectively. The second pipe section 48, which is supported by the second boom section 34, carries the quenching agent from the distal end of the first pipe section 46 to a proximal end of the third pipe section 50. Like FIGS. 3A and 3B, FIGS. 4A and 4B are illustrated such that the proximal end is on the left side and the distal end is on the right side of the figure.

As shown in FIG. 4A, the second boom section 34 includes a proximal coupling 126, pipe supports 128*a*, 128*b*, 128*c*, a boom body 130, and a distal coupling 132. The proximal coupling 126 of the second boom section 34 is pivotally coupled to the distal coupling 98 of the first boom section 32 such that the second boom section 34 may pivot with respect to the first boom section 32. The pipe supports 128*a*, 128*b*, 128*c* are mounted to the boom body 130, which applies the main structural support of the second boom section 34. The distal coupling 132 is pivotally coupled to a proximal end of the third boom section 36.

The second pipe section 48, as shown from left to right in FIG. 4B, includes a pipe elbow 134, a sealing ring 136, a rigid coupling 138, a pipe elbow 140, a rigid coupling 142, a sealing ring 144, a pipe 146, a rigid coupling 148, a sealing ring 150, and a pipe elbow 152. These components are rigidly connected together in an end-to-end manner and function to convey quenching agent from a proximal end of the second pipe section 48 to a distal end of the second pipe section 48. The pipe elbow 134, shown on the far left side in FIG. 4B, is pivotally coupled to the pipe elbow 118 of the first pipe section 46 by the swivel coupling 120. The second pipe section 48 is therefore capable of pivotal motion with respect to the first pipe section 46 without disturbing the integrity of the pipe line 16. The various components of the second pipe section 48 are fixed to the pipe supports 128*a*, 128*b*, 128*c* of the second boom section 34. The second pipe section 48 conveys quenching agent from the distal end of the first pipe section 46 to the proximal end of the third pipe section 40.

Figure 5A:
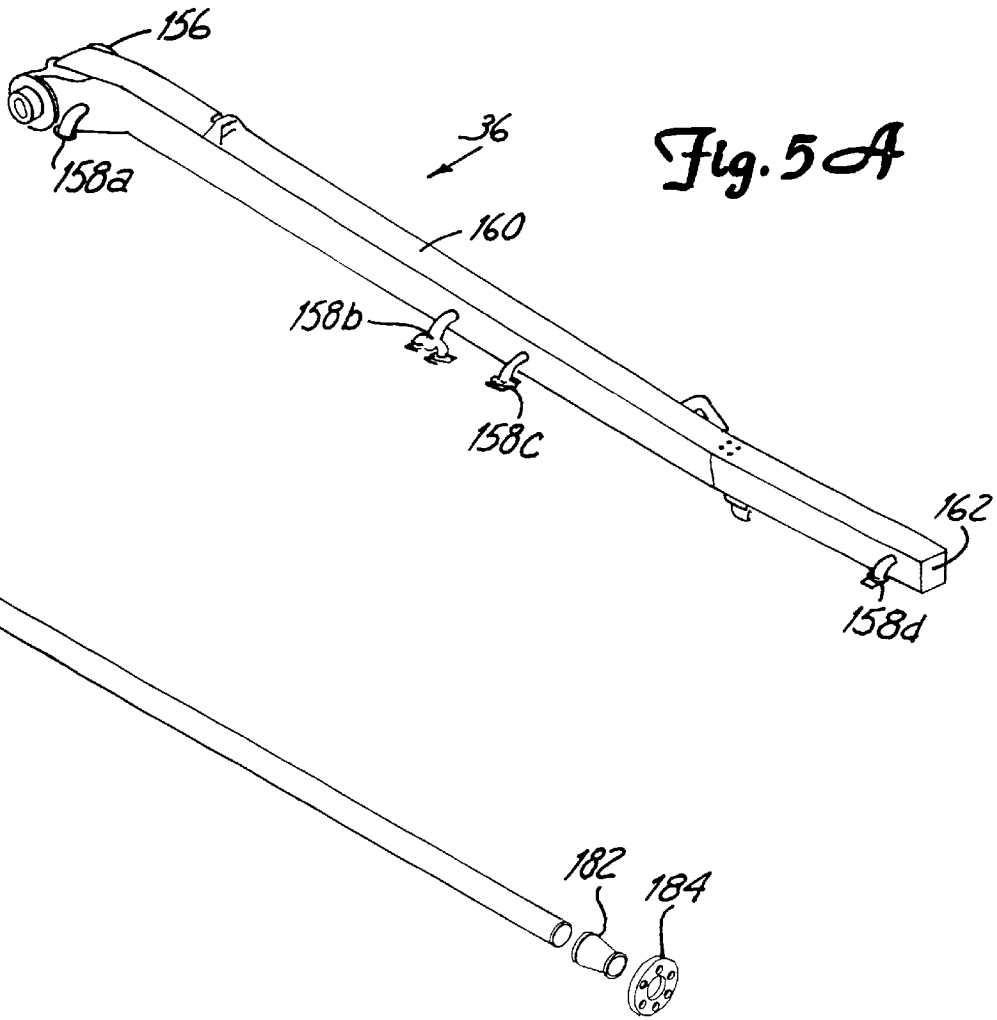
FIG. 5A is a perspective view of a third boom section according to the present invention.
Figure 5B:
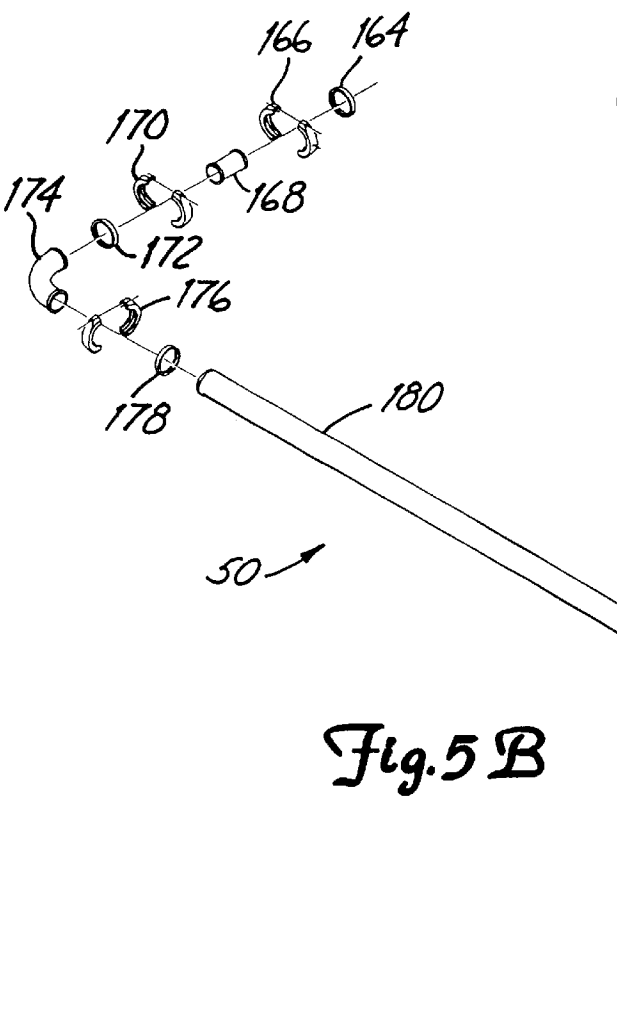
FIG. 5B is an exploded perspective view of a third pipeline section according to the present invention.

FIGS. 5A and 5B show perspective views of the third boom section 36 in the third pipe section 50, respectively. The third boom section 36 and the third pipe section 50 are shown if FIGS. 5A and 5B with a proximal end on the left side and a distal end on the right side of the figures.

As shown if FIG. 5A, the third boom section 36 includes a proximal coupling 156, pipe supports 158*a*, 158*b*, 158*c*, 158*d*, a boom body 160, and a distal end 162. The proximal coupling 156 pivotally couples to the distal coupling 132 of the second boom section 34 such that the third boom section 36 may pivot with respect to the second boom section 34 in the same general plane. The pipe supports 158*a*, 158*b*, 158*c*, 158*d* are coupled to the boom body 160 and act to support the third pipe section 50. The distal end 162 of the third boom section 36 supports the nozzle 18.

The third pipe section 50, as shown from left to right in FIG. 5B, includes a sealing ring 164, a swivel coupling 166, a pipe 168, a rigid coupling 170, a sealing ring 172, a pipe elbow 174, a rigid coupling 176, a sealing ring 178, a pipe 180, a reducer 182, and a flange 184. The third pipe section 50 is configured such that it allows pivotal motion of the third boom section 36 and the third pipe section 50 with respect to the second boom section 34 and the second pipe section 48. The third pipe section 50 must maintain a sealed coupling to the second pipe section 48 during pivotal movement of the third boom section 36 with respect to the second boom section 34. The component of the third pipe section 50 that allows this pivotal motion is the swivel coupling 166. The pipe 168 of the third pipe section 50 is pivotally coupled to the pipe elbow 152 of the second pipe section 48 by the swivel coupling 166. The swivel coupling 166 of the third pipe section 50 allows the pivotal motion of the third pipe section 50 with respect to the second pipe section 48. The pipe elbow 174 turns the third pipe section 50 ninety degrees such that the pipe 180 runs generally parallel to the third boom section 36. More specifically, the pipe 180 of the third pipe section 50 gradually approaches a center line of the boom body 160 of the third boom section 36 as it traverses from left to right in FIGS. 5A and 5B. In other words, the distal end of the third pipe section 50 is closer to the center line of the third boom section 36 than is the proximal end.

As shown at the right side of FIG. 5B, the reducer 182 and the flange 184 are coupled to a distal end of the pipe 180. The flange 184 is coupled to the nozzle 18. The various components of the third pipe section 50 function to convey quenching agent from a distal end of the second pipe section 48 to a distal end of the third pipe section 50. The quenching agent then flows out through the flange 184 and into the nozzle 18, which is the ultimate dispensing point for the quenching agent.

During operation, an operator may manipulate the quenching agent dispensing point by changing the positions of the boom section, 32, 34, 36 with respect to one another and by rotating the entire boom 14 with respect to the truck 12 using the turret 30. An operator may thereby position the quenching agent dispensing point in a position having the greatest fire combating efficacy. The device of the present invention allows the quenching agent to be dispensed at a point near the source of the fire without endangering equipment or fire fighting professionals.

Once the operator has properly positioned the boom 14, the pump 26 may be activated to convey quenching agent from the tank 24 (or other source) through the feed pipe section 44 to a proximal end of the first pipe section 46, through the first pipe section 46 to a proximal end of the second pipe section 48, through the second pipe section 48 to a proximal end of the third pipe section 50, and through the third pipe section 50 to the nozzle 18. The solid, articulable, conveying pipeline 16 also allows for maximum quenching agent flow rates.

The conveying pipeline 16 may have any overall length that is desirable and allows for the necessary quenching agent flow rates. In preferred embodiments, the conveying pipeline 16 has a length of 85 feet, 110 feet, or 130 feet. Also, should be apparent to one of ordinary skill in the art that shorter or longer booms could also be used with present invention. The conveying pipeline 16 design of the present invention will adequately pump quenching agent through pipe of these overall lengths.

In a preferred embodiment, the present invention utilizes a conveying pipeline 16 having an six or eight inch inside diameter. The motive force is generated using a single-stage centrifugal pump constructed from cast iron (pump body), stainless steel (impeller shaft), and bronze (impellers, clearance rings, and fittings). The pump 26 of the preferred embodiment is capable of generating a flow rate of 3000 gallons per minute at a pump discharge pressure of 150 pounds per square inch, a flow rate of 2100 gallons per minute at a pump discharge pressure of 200 pounds per square inch and a flow rate of 1500 gallons per minute at a pump discharge pressure of 250 pounds per square inch. To generate the above flow rates, the pump requires 470 horsepower input from the engine of the truck 12. Typically, the engine of the truck 12 can provide about 500 horsepower.

The conveying pipeline 16 of the fire-fighting system 10 of the present invention can support flow rates in excess of 3000 gallons per minute when the pump 26 can provide such flow rates. The pump 26 can provide a flow rate of 4,000 gallons per minute at 110 pounds per square inch pump discharge pressure when the quenching agent source is charged or pressurized to 10 pounds per square inch (e.g., a fire hydrant). This configuration allows the device of the present invention to generate a quenching agent volumetric flow rate of approximately 5,000 gallons per minute when the quenching agent source is sufficiently charged. The quenching agent flow rate, which may be modeled as laminar flow through a pipe, may be calculated using the following equation for ideal flow:

$$Q = \frac{\pi(\Delta p - pg\Delta)D^4}{128\ \mu l}$$

where Q is the volumetric flow rate, Δp is the change in pressure between a pipe inlet and a pipe exit, ρ is the fluid density, D is the diameter of the pipe, $\mu$ is the fluid viscosity, and 1 is the length of the pipe. The above equation cannot be used to accurately calculate flow rates for the fire-fighting system 10 of the present invention for at least two reasons. The fire-fighting system 10, which generates flow rates up to 5,000 gallons per minute, is operating at a Reynolds number well in excess of 4000, and thus the flow of quenching agent is turbulent, not laminar. Also, the conveying pipeline 16 of the fire-fighting system 10 is not an ideal pipe. Pressure losses occur in the pipeline 16 due to frictional forces, bends in the pipeline 16, and irregularities at the pipe joints.

The above equation, however, does accurately show the general effect of adjustments to one of the parameters on volumetric flow rate. As is apparent from this equation, the volumetric flow rate is strongly dependent on the diameter of the pipe. For example, an increase in the diameter of the pipe by a factor of two will result in an increase in the flow rate by a factor of sixteen (two to the power of four). It is apparent, therefore, that a system, such as that of the present invention, having an increased diameter pipe will greatly improve the overall quenching agent volumetric flow rate.

As described herein, the preferred embodiment uses a pipeline having an inside diameter of at least six inches and preferably eight inches. It should be understood, however, that the teachings of the present invention would apply equally as well to a device using larger than eight inch pipeline. Although the present invention has been described with reference to preferred embodiments, workers skilled in the art will recognize that changes may be made in form and detail without departing from the spirit and scope of the invention.

What is claimed is:

1. An improved fire-fighting system for dispensing a quenching agent on a fire source, the fire-fighting system comprising:

a solid mounting structure;

at least three boom sections connected together in an articulated arrangement, one of the at least three boom sections rotatably coupled to the solid mounting structure;

conveying pipeline means for delivering the quenching agent at a throughput of at least about 3,000 gallons per minute, the conveying pipeline means including a conveying pipeline being formed of solid-walled pipe sections having an inside diameter of at least about six inches and being coupled to and articulable with the at least three boom sections;

a nozzle connected to a distal end of the conveying pipeline; and pump means for pumping the quenching agent under pressure through the conveying pipeline means to the nozzle at a turbulent flow rate of at least about 3,000 gallons per minute when a pump discharge pressure is 150 pounds per square inch, the pump means including a pump supported by the solid mounting structure and coupled between a source of the quenching agent and a proximal end of the conveying pipeline.

2. The fire-fighting system of claim 1 wherein the at least three boom sections include a first boom section, a second boom section, and a third boom section, and further wherein the first boom section is rotatably coupled to the solid mounting structure.

3. The fire-fighting system of claim 2 wherein the conveying pipeline includes a first pipe section, a second pipe section, and a third pipe section coupled to the first boom section, the second boom section, and the third boom section, respectively.

4. The fire-fighting system of claim 3 wherein the first pipe section is pivotally coupled to the second pipe section by a first swivel coupling, and the second pipe section is pivotally coupled to the third pipe section by a second swivel coupling.

5. The fire-fighting system of claim 1 wherein the conveying pipeline includes at least three pipe sections, the at least three pipe sections coupled to the at least three boom sections, respectively.

6. The fire-fighting system of claim 1 wherein the conveying pipeline delivers the quenching agent at a throughput of at least about 5,000 gallons per minute.

7. The fire-fighting system of claim 1 wherein the conveying pipeline is constructed from pipe sections having an inside diameter of at least about eight inches.

8. The fire-fighting system of claim 1 further comprising at least two actuator assemblies interposed between adjacent boom sections for controlling the angle between adjacent boom sections.

9. The fire-fighting system of claim 1 further comprising a tank mounted to the solid mounting structure wherein the tank stores the quenching agent.

10. The fire-fighting system of claim 1 further comprising an inlet for supplying the quenching agent to the pump at a pressure of at least about 10 pounds per square inch wherein the pump pumps at least about 4,000 gallons per minute of the quenching agent.

11. The fire-fighting system of claim 1 wherein the pump pumps about 2,100 gallons per minute of the quenching agent when the pump discharge pressure is about 200 pounds per square inch.

12. The fire-fighting system of claim 1 wherein the pump pumps about 1,500 gallons per minute of the quenching agent when the pump discharge pressure is about 250 pounds per square inch.

13. An improved fire-fighting vehicle for dispensing a quenching agent on a fire source, the fire-fighting vehicle comprising:

a truck chassis;

at least three boom sections connected together in an articulated arrangement, one of the at least three boom sections coupled to the truck chassis;

at least two actuator assemblies interposed between adjacent boom sections wherein the angle between adjacent boom sections is controlled by the actuator assemblies;

conveying pipeline means for transporting the quenching agent from a proximal end to a distal end, the conveying pipeline means including a conveying pipeline being formed of solid-walled pipe sections attached to and articulable with the at least three boom sections;

wherein the conveying pipeline means have an inside diameter of at least about six inches and a quenching agent throughput of about 5,000 gallons per minute;

a nozzle connected to the distal end of the conveying pipeline; and pump means for receiving the quenching agent under pressure at a pump inlet and for delivering the quenching agent through a pump outlet to the proximal end of the conveying pipeline at a pump discharge pressure and flow rate which generates a turbulent quenching agent volumetric flow rate of about 5,000 gallons per minute through the conveying pipeline, the pump means including a pump mounted on the truck chassis.

14. The fire-fighting vehicle of claim 13 wherein the at least two actuator assemblies include a first actuator assembly and a second actuator assembly.

15. The fire-fighting vehicle of claim 13 further comprising a tank mounted to the chassis wherein the tank holds the quenching agent.

16. The fire-fighting vehicle of claim 13 wherein the conveying pipeline has an inside diameter of at least about eight inches.

17. A method for dispensing a quenching agent on a fire source, the method comprising:

moving to a site of the fire source a solid mounting structure, the solid mounting structure including at least three boom sections connected together in an articulated arrangement wherein one of the at least three boom sections is rotatably coupled to the solid mounting structure, a solid-walled, articulable, conveying pipeline having a distal end and a proximal end, the conveying pipeline being attached to the boom sections and having a nozzle connected to the distal end wherein the conveying pipeline has an inside diameter of at least about six inches and delivers the quenching agent at a throughput of at least about 3,000 gallons per minute, and a pump supported by the solid mounting structure and coupled between a source of the quenching agent and the proximal end of the conveying pipeline;

positioning the at least three boom sections to place the nozzle at a desired location with respect to the fire source; and operating the pump to pump the quenching agent under pressure from the source to the nozzle at a pump discharge pressure of 150 pounds per square inch and through the conveying pipeline at a turbulent flow rate of at least about 3,000 gallons per minute so that the quenching agent is delivered from the nozzle onto the fire source.

18. The method of claim 17 wherein the conveying pipeline has an inside diameter of at least about eight inches.

19. The method of claim 17 wherein the conveying pipeline delivers the quenching agent at a throughput of at least about 5,000 gallons per minute.

20. The method of claim 17 wherein the pump discharge pressure is 200 pounds per square inch and the quenching agent is pumped through the conveying pipeline to the nozzle at a flow rate of about 2,100 gallons per minute.

21. The method of claim 17 wherein the pump discharge pressure is 250 pounds per square inch and the quenching agent is pumped through the conveying pipeline to the nozzle at a flow rate of about 1,500 gallons per minute.

22. The method of claim 17, and further comprising:

supplying the quenching agent to the pump through an inlet at a pressure of at least about 10 pounds per square inch wherein the pump pumps at least about 4,000 gallons per minute of the quenching agent.

23. The method of claim 17, and further comprising:

storing the quenching agent in a tank mounted to the solid mounting structure.

* * * * *